US007213297B2

(12) United States Patent
Nam et al.

(10) Patent No.: US 7,213,297 B2
(45) Date of Patent: May 8, 2007

(54) VACUUM CLEANER HAVING SUCTION/EXHAUSTION SWITCH

(75) Inventors: Hyeun-Sik Nam, Seoul (KR); Young-Woo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 542 days.

(21) Appl. No.: 10/739,331

(22) Filed: Dec. 19, 2003

(65) Prior Publication Data

US 2004/0237246 A1 Dec. 2, 2004

(30) Foreign Application Priority Data

May 26, 2003 (KR) ..... 10-2003-0033476

(51) Int. Cl.
*A47L 5/14* (2006.01)
*A47L 9/00* (2006.01)

(52) U.S. Cl. ..... 15/334; 15/330; 15/331

(58) Field of Classification Search ..... 15/228, 15/334, 331, 335, 330, 345
See application file for complete search history.

(56) References Cited

U.S. PATENT DOCUMENTS

| | | | | |
|---|---|---|---|---|
| 2,227,302 | A * | 12/1940 | Edstrom | 15/330 |
| 3,238,556 | A * | 3/1966 | Martin | 15/330 |
| 3,605,786 | A * | 9/1971 | Machin, Jr. | 15/330 |
| 4,663,799 | A | 5/1987 | Kiyooka | 15/330 |
| 5,243,733 | A | 9/1993 | Steiner et al. | 15/330 |
| 5,355,549 | A | 10/1994 | Steinberg et al. | 15/334 |
| 2002/0108207 | A1 | 8/2002 | Oohama | 15/330 |
| 2004/0250373 | A1 * | 12/2004 | Rew et al. | 15/330 |

FOREIGN PATENT DOCUMENTS

| | | |
|---|---|---|
| JP | 2001-037683 | 2/2001 |
| JP | 2001-198054 | 7/2001 |
| KR | 10-2001-0065093 | 7/2001 |
| KR | 0065093 | 7/2001 |

OTHER PUBLICATIONS

English language Abstract of JP 2001-037683.
English language Abstract of JP 2001-198054.
Englidh language Absrtact of KR 10-2001-0065093.

* cited by examiner

*Primary Examiner*—Theresa T. Snider
(74) *Attorney, Agent, or Firm*—Greenblum & Bernstein, P.L.C.

(57) ABSTRACT

A vacuum cleaner includes a body having a suction motor for generating a suction force, a filter for filtering dust sucked in by the suction motor, and an outlet for exhausting air which has been filtered by the filter. A suction head is provided at one side of the body for sucking dust and a suction/exhaustion switch is installed between the body and the suction head. The suction head includes a channel switching valve assembly installed at a lateral surface of the body, a head side suction hose connected between the channel switching valve assembly and the suction head and a body side suction hose connecting the body and the channel switching valve assembly. A suction/exhaustion hose is connected to the channel switching valve assembly for exhausting a part of the exhaustion air exhausted through the outlet to the outside of the body or for sucking dust through the channel switching valve assembly.

9 Claims, 6 Drawing Sheets

VACUUM CLEANER HAVING SUCTION/EXHAUSTION SWITCH

BACKGROUND OF THE INVENTION

1. Field of the Invention

The present invention relates to a vacuum cleaner, and more particularly, to a vacuum cleaner for removing dust or foreign materials by using a suction force of a suction motor installed in a body.

2. Description of the Conventional Art

FIG. 1 is a perspective view showing an upright type vacuum cleaner in accordance with the conventional art.

As shown, the conventional upright type vacuum cleaner is provided with a body 1 vertically arranged, a handle 1*a* formed at an upper portion of the body 1, and a suction head 2 formed at a lower portion of the body 1 for sucking dust or foreign materials.

A suction hose 3 is connected between the suction head 2 and the body 1, and a suction motor (not shown) is installed in the body 1.

Dust and foreign materials sucked into the suction head 2 by a suction force generated by the suction motor pass through the suction hose 3 thus to be sucked into the body 1, and then are filtered by a filter 4 installed in the body 1.

An outlet 5 for exhausting air which has been sucked into the body 1 and then filtered is formed at a lateral surface of the body 1.

In the conventional upright type vacuum cleaner, dust or foreign materials are sucked into the suction head 2 by a suction force generated from the suction motor, and pass through the filter 4 thus to be filtered in the body 1. The filtered air is exhausted to outside of the body 1 through the outlet 5.

However, in the conventional upright type vacuum cleaner, a cleaning is performed only with a suction force, so that dust or foreign materials in a narrow position such as a window frame or a indoor corner can not be easily removed.

SUMMARY OF THE INVENTION

Therefore, an object of the present invention is to provide a vacuum cleaner capable of easily removing dust or foreign materials in a narrow position such as a window frame or an indoor corner by using an exhaustion force of a part of exhaustion air exhausted to an outlet.

To achieve these and other advantages and in accordance with the purpose of the present invention, as embodied and broadly described herein, there is provided a vacuum cleaner comprising: a body having a suction motor for generating a suction force, a filter for filtering dust sucked by the suction motor, and an outlet for exhausting air which has been filtered by the filter; a suction head installed at one side of the body for sucking dust; and a suction/exhaustion switching means installed between the body and the suction head for selectively using an exhaustion force of a part of exhaustion air exhausted through the outlet or a suction force of the suction motor.

The suction/exhaustion switching means comprises: a channel switching valve assembly installed at a lateral surface of the body; a head side suction hose for connecting the channel switching valve assembly and the suction head; a body side suction hose for connecting the body and the channel switching valve assembly; and a suction/exhaustion hose for exhausting a part of exhaustion air exhausted to the outlet to outside of the body or for sucking dust by the channel switching valve assembly.

The channel switching valve assembly comprises: a coupling portion protruding at a lateral surface of the body and provided with a subsidiary outlet formed at a bottom surface thereof for exhausting a part of exhaustion air exhausted through the outlet; a valve case detachably coupled to the coupling portion, provided with a connection hole connected to the subsidiary outlet at a bottom surface thereof, and provided with a head side connection pipe connected to a head side suction hose, a body side connection pipe connected to the body side suction hose, and a suction/exhaustion side connection pipe connected to the suction/exhaustion hose at an outer circumferential surface thereof with a constant interval; a rotation valve rotatably installed in the valve case, provided with a horizontal channel formed at one side thereof for selectively connecting the head side connection pipe and the body side connection pipe or the head side connection pipe and the suction!exhaustion side connection pipe, and provided with a vertical channel formed at another side thereof for connecting the subsidiary outlet, the connection hole, and the exhaustion side connection pipe; and a cover coupled to the valve case.

The coupling portion is provided with a bolt hole for coupling the valve case by a bolt, and a flange having a bolt hole is formed at an outer circumferential surface of the valve case.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
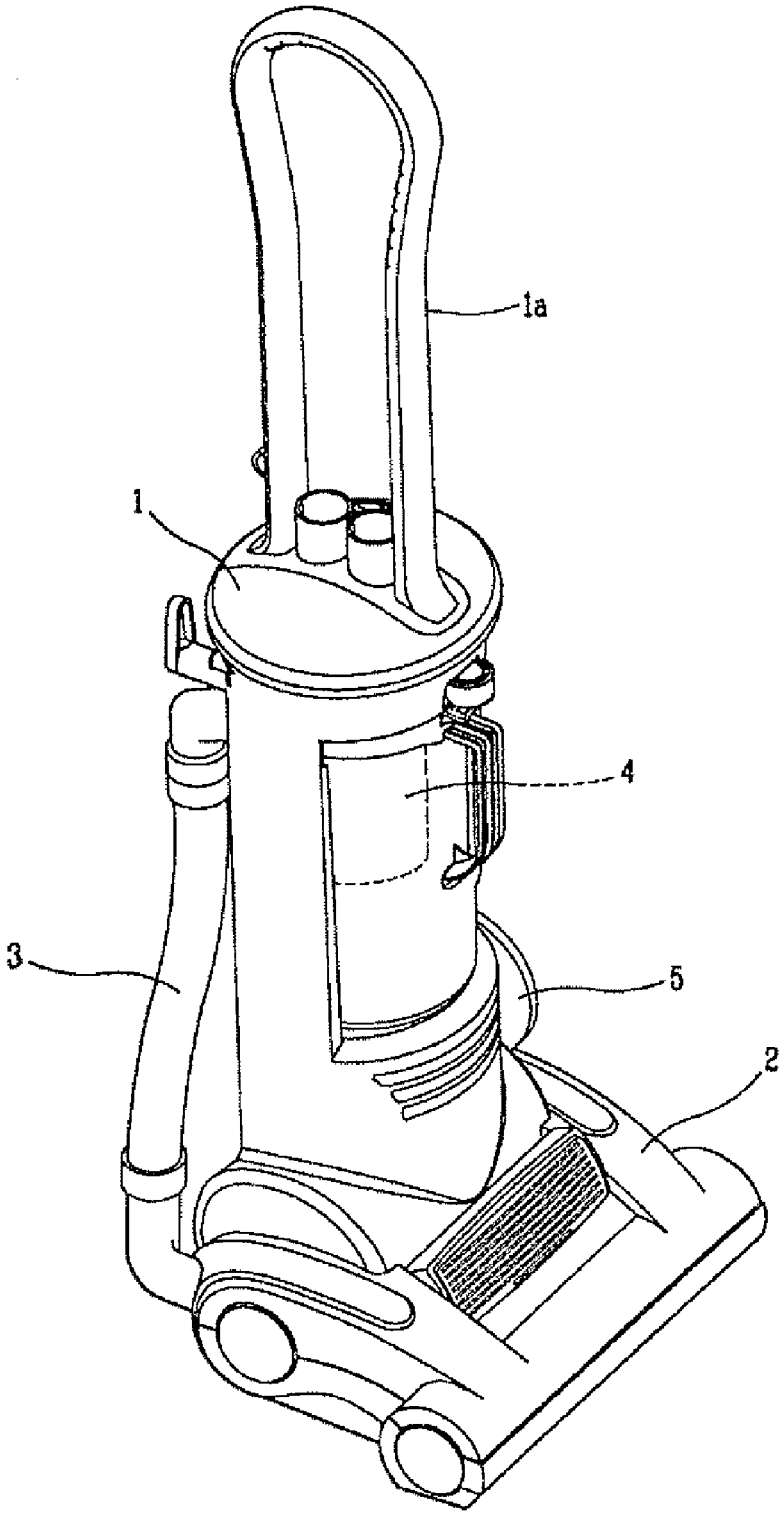
FIG. 1 CONVENTIONAL ART
FIG. 1 is a longitudinal section view showing an upright type vacuum cleaner in accordance with the conventional art.

Reference will now be made in detail to the preferred embodiments of the present invention, examples of which are illustrated in the accompanying drawings.

Hereinafter, a vacuum cleaner according to the present invention will be explained.

As shown, the vacuum cleaner according to the present invention comprises: a body 101 having a suction motor (not shown) for generating a suction force, a filter 101*a* for filtering dust sucked by the suction motor, and an outlet 101*b* for exhausting air which has been filtered by the filter 101*a*; a suction head 102 installed at a lower portion of the body 101 for sucking dust; and a suction/exhaustion switching means 200 installed between the body 101 and the suction head 102.

The suction/exhaustion switching means 200 comprises: a channel switching valve assembly 210 installed at a lateral surface of the body 101; a head side suction hose 220 for connecting the channel switching valve assembly 210 and the suction head 102; a body side suction hose 230 for connecting the body 101 and the channel switching valve assembly 210; and a suction/exhaustion hose 240 for exhausting a part of exhaustion air exhausted to the outlet 101*b* to outside of the body 101 or for sucking dust by the channel switching valve assembly 210, selectively.

The channel switching valve assembly 210 comprises: a coupling portion 211 protruding at a lateral surface of the body 101 and provided with a subsidiary outlet 211*a* formed at a bottom surface thereof for exhausting a part of exhaustion air exhausted through the outlet 101*b*; a valve case 212 detachably coupled to the coupling portion 211, provided with a connection hole 212*a* connected to the subsidiary outlet 211*a* at a bottom surface thereof, and sequentially provided with a head side connection pipe 212*b* connected to the head side suction hose 220, a body side connection pipe 212*c* connected to the body side suction hose 230, and a suction/exhaustion side connection pipe 212*d* connected to the suction/exhaustion hose 240 at an outer circumferential surface thereof with a constant interval; a rotation valve 213 rotatably installed in the valve case 212, provided with a horizontal channel 213*a* formed at one side thereof for selectively connecting the head side connection pipe 212*b* and the body side connection pipe 212*c* or the head side connection pipe 212*b* and the suction/exhaustion side connection pipe 212*d*, and provided with a vertical channel 213*b* formed at another side thereof for connecting the subsidiary outlet 211*a*, the connection hole 212*a*, and the exhaustion side connection pipe 212*d*; and a cover 214 coupled to the valve case 212.

It is preferable that the coupling portion 211 is integrally formed at a lateral surface of the body 101, and the subsidiary outlet 211*a* formed at a bottom surface of the coupling portion 211 exhausts a part of exhaustion air which is just before being exhausted to the outlet 101*b* to the suction/exhaustion hose 240.

The valve case 212 is formed of a cylindrical shape, and the connection hole 212*a* formed at the bottom surface of the valve case 212 connects the subsidiary outlet 211*a* and the suction/exhaustion side connection pipe 212*d*.

The head side connection pipe 212*b*, the body side connection pipe 212*c*, and the suction/exhaustion side connection pipe 212*d* installed at the outer circumferential surface of the valve case 212 are arranged at a position corresponding to approximately 120° from a center of the valve case 212.

A bolt hole H for coupling the valve case 212 to the coupling portion 211 by a bolt B is formed at the coupling portion 211, and a flange 212*e* having a bolt hole H is formed at an outer circumferential surface of the valve case 212.

One side of the head side suction hose 220 is connected to the suction head 102, and another side thereof is connected to the head side connection pipe 212*b*. One side of the body side suction hose 230 is connected to the body 101, and another side thereof is connected to the body side connection pipe 212*c* of the valve case 212. One side of the suction/exhaustion hose 240 is connected to the suction/exhaustion side connection pipe 212*d* of the valve case 212, and another side thereof is provided with a nozzle 241.

The rotation valve 213 of a cylindrical shape is rotatably installed in the valve case 212, and both ends of the horizontal channel 213*a* of the rotation valve 213 are arranged at a position corresponding to approximately 120° from a center of the rotation valve 213 like the head side connection pipe 212*b*, the body side connection pipe 212*c*, and the suction/exhaustion side connection pipe 212*d*.

The vertical channel 213*b* of the rotation valve 213 is formed accordingly as a bottom surface and a lateral surface of the rotation valve 213 are cut.

A handle 213*c* of a straight type is formed at a surface of the rotation valve 213, and stoppers 214*a* corresponding to the handle 213*c* are formed to face each other at an inner circumferential surface of the cover 214 of a ring shape.

Both ends of the stopper 214*a* are arranged at a position corresponding to approximately 120° from a center of the cover 214.

Accordingly, when a user rotates the handle 213*c* clockwise or counterclockwise, an end of the handle 213*c* is in contact with an end of the stopper 214*a*. At this time, since a rotation angle of the rotation valve 213 is limited to approximately 120°, the horizontal channel 213*a* can selectively connect the head side connection pipe 212*b* and the body side connection pipe 212*c* or the head side connection pipe 212*b* and the suction/exhaustion side connection pipe 212*d*.

The bolt holes H are formed at the valve case 212 and the cover 214 in order to couple the cover 214 to the valve case 212.

Figure 8:
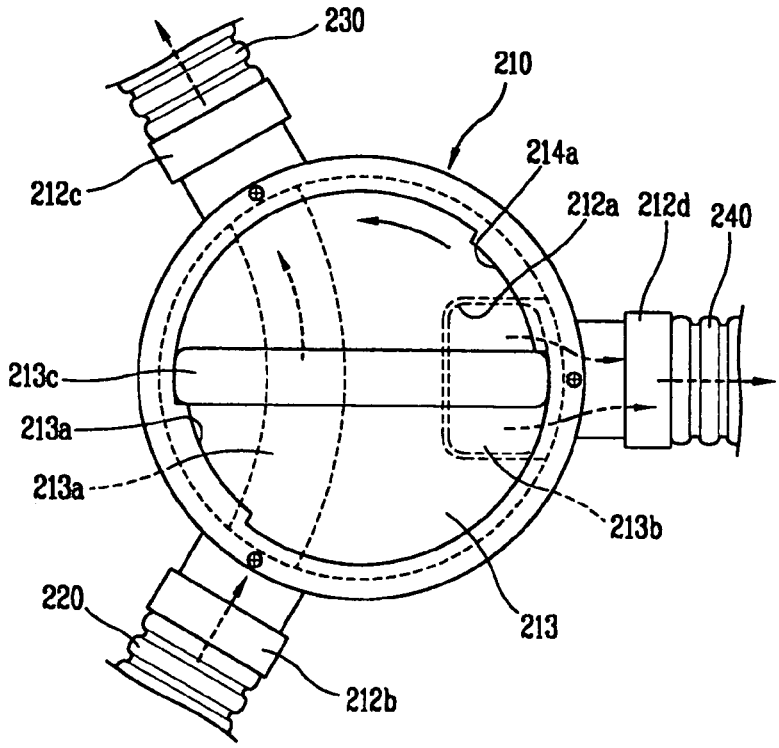
FIG. 8 is a plane view showing a state that a body side suction hose and a head side suction hose are connected to each other and exhaustion gas inside of an outlet is partially exhausted to a suction/exhaustion hose.

In the vacuum cleaner according to the present invention, when a cleaning is performed by using the suction head 102, as shown in FIG. 8, the handle 213*c* of the rotation valve 213 is rotated counterclockwise. According to this, both ends of the handle 213*c* are in contact with the stopper 214*a* and thereby a rotation of the handle 213*c* is limited. At this time, both ends of the horizontal channel 213*a* are connected to the head side connection pipe 212*b* and the body side connection pipe 212*c*, respectively.

Figure 3:
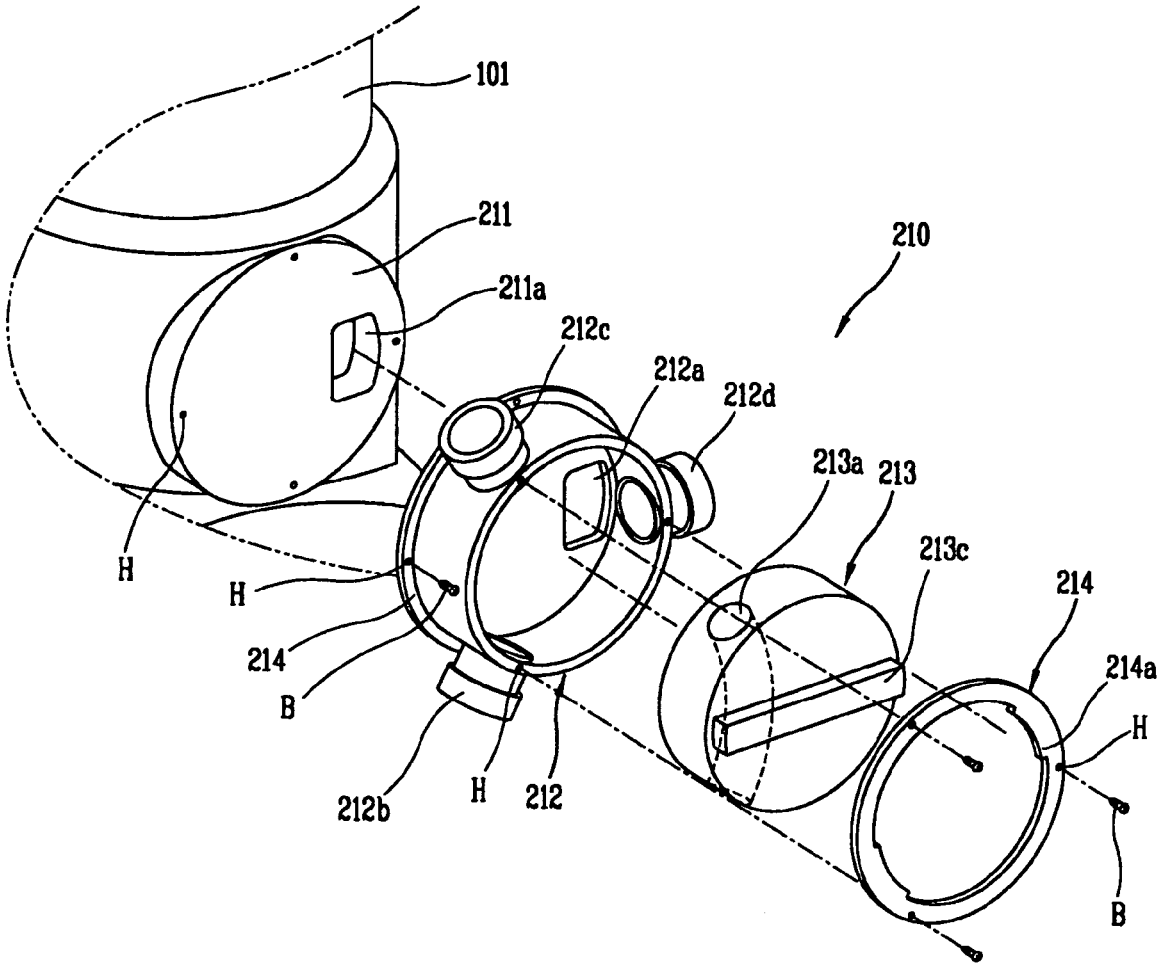
FIG. 3 is a disassembled perspective view showing a channel switching valve assembly according to the present invention.
Figure 4:
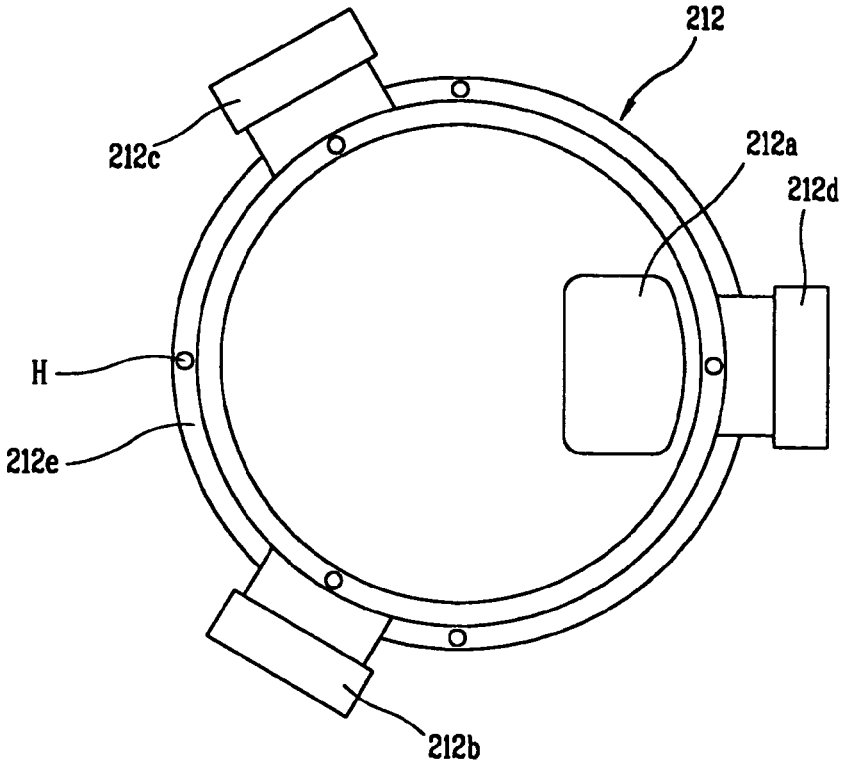
FIG. 4 is a plane view showing a valve case according to the present invention.
Figure 5:
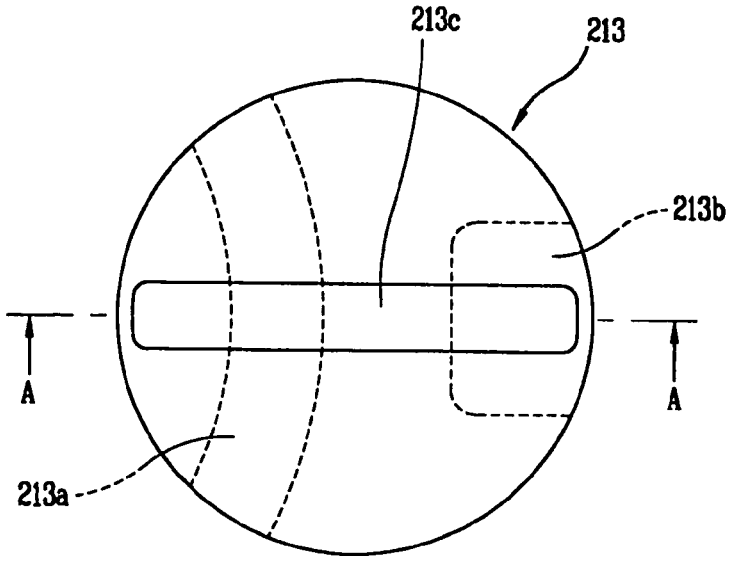
FIG. 5 is a plane view showing a rotation valve according to the present invention.
Figure 6:
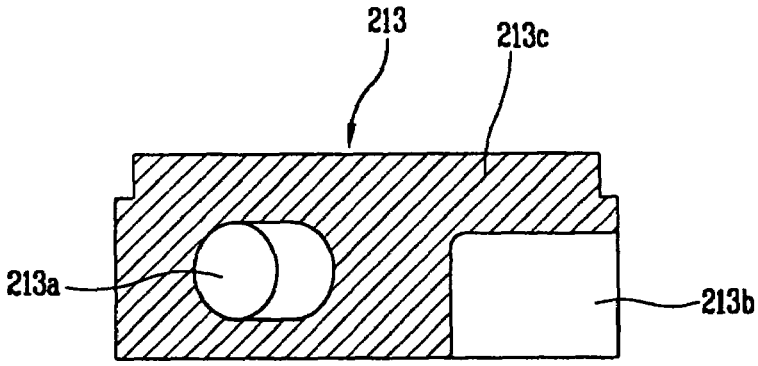
FIG. 6 is a sectional view taken along line A—A of FIG. 5.
Figure 7:
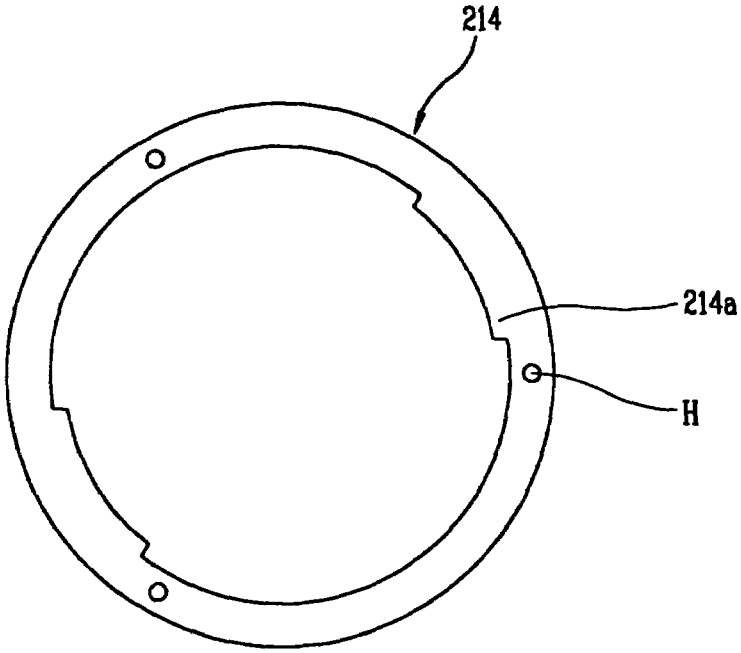
FIG. 7 is a plane view showing a cover according to the present invention.

At the same time, the subsidiary outlet 211*a* (Refer to FIG. 3), the connection hole 212*a*, and the vertical channel 213*b* are connected to one another.

Figure 2:
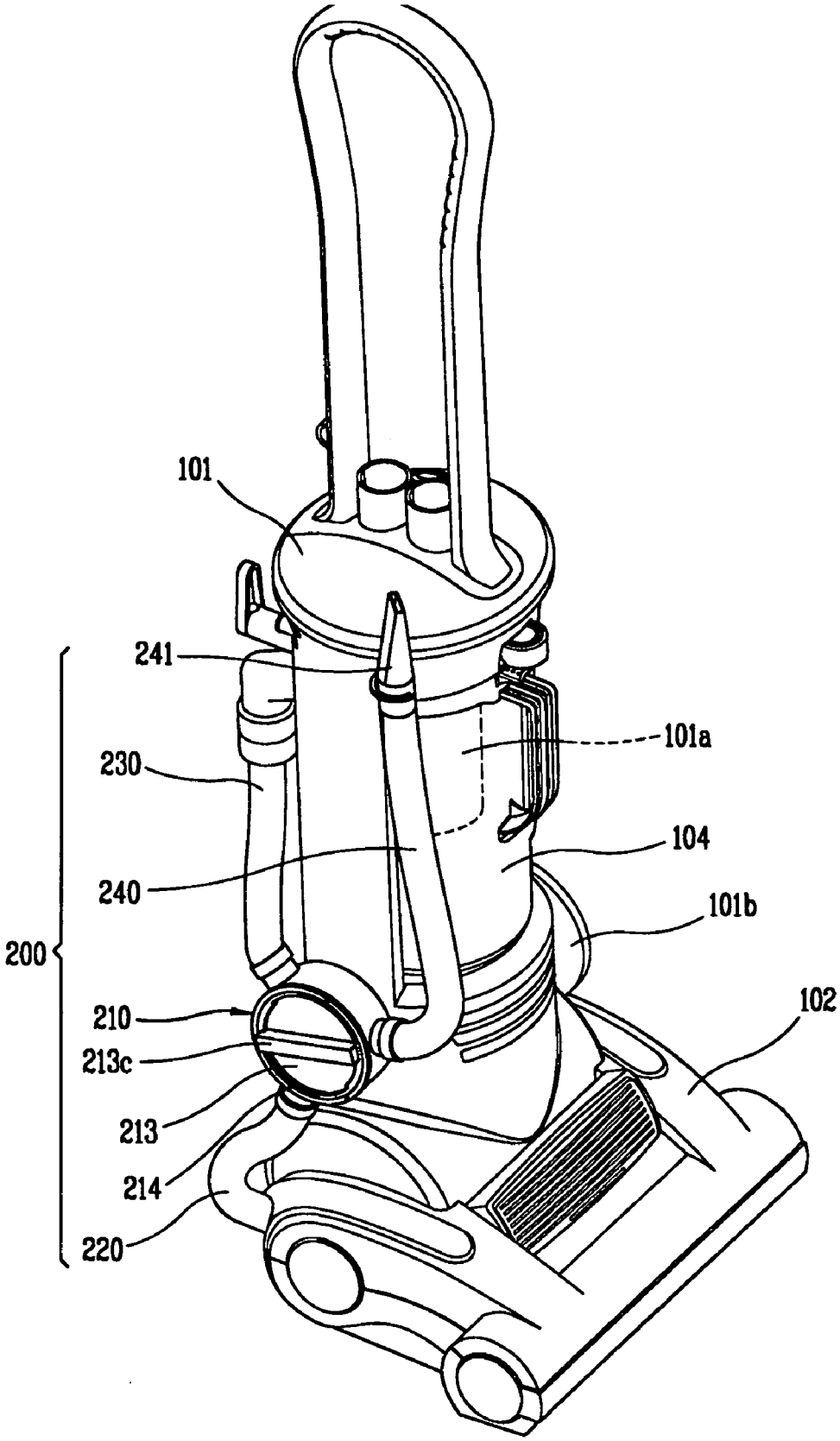
FIG. 2 is a perspective view showing a vacuum cleaner according to the present invention.

Under said state, as shown in FIG. 2, the suction motor is operated to suck dust or foreign materials into the suction head 102 by a suction force of the suction motor. The sucked dust or foreign materials pass through the head side suction hose 220, the horizontal channel 213*a*, and the body side suction hose is 230 thus to be sucked into the body 101.

The dust or foreign materials sucked into the body 101 pass through the filter 101*a* to be filtered, and air which has been filtered by the filter 101*a* is exhausted to outside of the body 101 through the outlet 101*b*.

A part of air exhausted through the outlet 101*b* is exhausted to the subsidiary outlet 211*a*, and the air which has been exhausted to the subsidiary outlet 211*a* passes through the connection hole 212*a* and the vertical channel 213*b* thus to be exhausted through the nozzle 241 of the suction/exhaustion hose 240.

Dust or foreign materials which exist at a window frame or an indoor corner are blown by using an exhaustion pressure of exhaustion air exhausted through the nozzle 241, and then the dust or foreign materials are sucked and removed through the suction head 102 like the aforementioned operation.

Meanwhile, in case that the suction head 102 can not be used due to a high position to be cleaned or an obstacle, the suction/exhaustion hose 240 is used to perform a cleaning, which will be explained with reference to FIG. 9.

Figure 9:
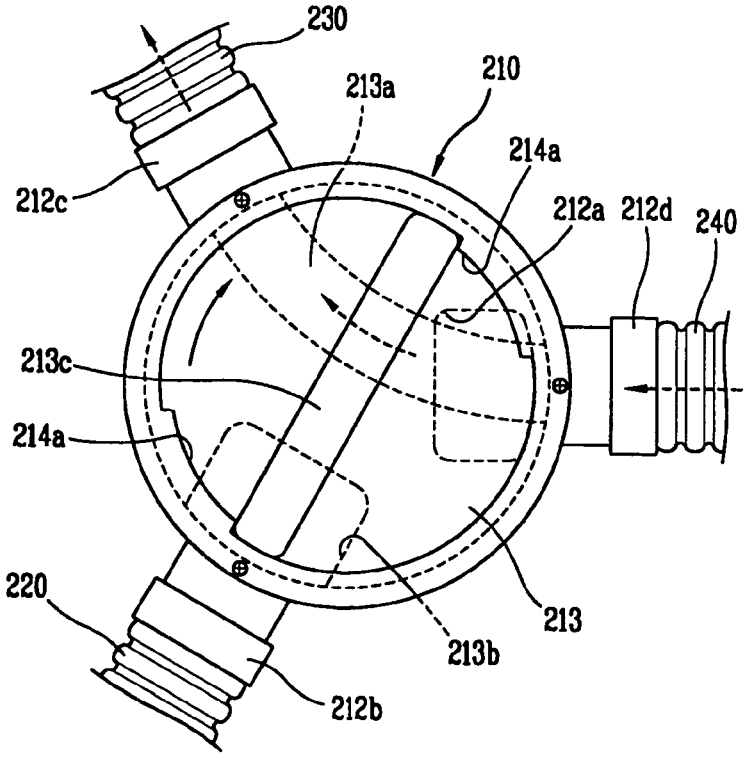
FIG. 9 is a plane view showing a state that the body side suction hose is connected to the suction/exhaustion hose and thereby dust is sucked through the suction/exhaustion hose.

As shown in FIG. 9, when the handle 213*c* of the rotation valve 213 is rotated clockwise, both ends of the handle 213*c* are in contact with the stopper 214*a* and thereby a rotation of the handle 213*c* is limited. At this time, both ends of the horizontal channel 213*a* are connected to the body side connection pipe 212*c* and the suction/exhaustion side connection pipe 212*d*, respectively. At the same time, the subsidiary outlet 211*a* and the connection hole 212*a* are shielded by the rotation valve 213.

Under said state, when the suction motor is operated, dust or foreign materials are sucked through the suction/exhaustion hose 240 by a suction force of the suction motor. The sucked dust or foreign materials pass through the horizontal channel 213*a* and the body side suction hose 230 thus to be sucked into the body 101.

The dust or foreign materials sucked into the body 101 pass through the filter 101*a* to be filtered, and air which has been filtered is exhausted to outside of the body 101 through the outlet 101*b*. Therefore, a space where the suction head 102 can not be moved, can be cleaned by the suction/exhaustion hose 240.

As aforementioned, according to the present invention, the channel switching valve assembly is controlled thus to use a suction force generated from the suction motor and use an exhaustion force of a part of exhaustion air exhausted to the subsidiary outlet, thereby easily cleaning dust or foreign materials in a narrow position such as a window frame or an indoor corner.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A vacuum cleaner comprising:

a body having a suction motor for generating a suction force, a filter for filtering dust sucked in by the suction motor, and an outlet for exhausting air which has been filtered by the filter;

a suction head provided at one side of the body for sucking dust; and a suction/exhaustion switch installed between the body and the suction head, said suction/exhaustion switch comprising:

a channel switching valve assembly provided at a lateral surface of the body;

a head side suction hose configured for connecting the channel switching valve assembly and the suction head;

a body side suction hose configured for connecting the body and the channel switching valve assembly; and a suction/exhaustion hose configured for connection to the channel switching valve assembly for exhausting a part of the exhaustion air exhausted through the outlet to the outside of the body or for sucking dust through the channel switching valve assembly.

2. The vacuum cleaner of claim 1, wherein the channel switching valve assembly comprises:

a coupling portion protruding at the lateral surface of the body and provided with a subsidiary outlet formed at a bottom surface thereof for exhausting the part of the exhaustion air exhausted through the outlet;

a valve case detachably coupled to the coupling portion, provided with a connection hole connected to the subsidiary outlet at a bottom surface thereof, and provided with a head side connection pipe connected to the head side suction hose, a body side connection pipe connected to the body side suction hose, and a suction/exhaustion side connection pipe connected to the suction/exhaustion hose at an outer circumferential surface thereof; and a rotation valve rotatably installed in the valve case, provided with a horizontal channel at one side thereof for selectively connecting the head side connection pipe and the body side connection pipe or the head side connection pipe and the suction/exhaustion side connection pipe, and provided with a vertical channel at another side thereof for connecting the subsidiary outlet, the connection hole, and the suction/exhaustion side connection pipe.

3. The vacuum cleaner of claim 2, wherein the coupling portion is provided with a bolt hole for coupling the valve case thereto by a bolt, and a flange having a bolt hole is provided at the outer circumferential surface of the valve case.

4. The vacuum cleaner of claim 2, wherein a cover is coupled to the valve case.

5. The vacuum cleaner of claim 4, wherein the cover is coupled by a bolt.

6. The vacuum cleaner of claim 2, wherein the head side connection pipe, the body side connection pipe, and the suction/exhaustion side connection pipe are arranged with an angle of 120° with respect to one another.

7. The vacuum cleaner of claim 4, wherein the valve case comprises a cylindrical shape, the rotation valve of the valve case comprises a cylindrical shape, and the cover comprises a ring shape.

8. The vacuum cleaner of claim 7, wherein a handle is provided at an outer surface of the rotation valve, and stoppers for limiting a rotation angle of the rotation valve are provided at an inner circumferential surface of the cover.

9. The vacuum cleaner of claim 8, wherein the stoppers are positioned to face each other at the inner circumferential surface of the cover.

* * * * *